US007446079B2

(12) United States Patent
Fadel et al.

(10) Patent No.: US 7,446,079 B2
(45) Date of Patent: Nov. 4, 2008

(54) PERFUMES FOR RINSE-OFF SYSTEMS

(75) Inventors: Addi Fadel, Shelton, CT (US); Richard Turk, Plymouth, MA (US); Grant Mudge, West Redding, CT (US); Jill Mattila, Greensboro, NC (US); Jack Esteves, Trumbull, CT (US); John Ranciato, New Haven, CT (US)

(73) Assignee: Givaudan Fragrances Corporation, Mount Olive, NJ (US)

( * ) Notice: Subject to any disclaimer, the term of this patent is extended or adjusted under 35 U.S.C. 154(b) by 375 days.

(21) Appl. No.: 11/385,452

(22) Filed: Mar. 21, 2006

(65) Prior Publication Data

US 2007/0099804 A1 May 3, 2007

Related U.S. Application Data

(60) Provisional application No. 60/669,120, filed on Apr. 7, 2005.

(51) Int. Cl.
*C11D 3/50* (2006.01)

(52) U.S. Cl. ..... 510/101; 512/1

(58) Field of Classification Search ..... 510/101; 512/1

See application file for complete search history.

(56) References Cited

U.S. PATENT DOCUMENTS

| | | | | |
|---|---|---|---|---|
| 6,143,707 | A | 11/2000 | Trinh et al. | 510/220 |
| 6,455,086 | B1 | 9/2002 | Trinh et al. | 426/321 |
| 6,601,789 | B1 | 8/2003 | Bajadali et al. | 241/301 |
| 6,858,574 | B2 | 2/2005 | Yang et al. | 512/1 |
| 2002/0055452 | A1 | 5/2002 | McGee et al. | 512/2 |
| 2003/0022805 | A1 | 1/2003 | Clare | 510/220 |
| 2003/0166498 | A1 | 9/2003 | Yang et al. | 512/1 |
| 2004/0138078 | A1 | 7/2004 | Clare et al. | 510/220 |
| 2006/0003031 | A1 * | 1/2006 | Fadel et al. | 424/725 |
| 2006/0207037 | A1 | 9/2006 | Fadel et al. | 8/406 |

FOREIGN PATENT DOCUMENTS

| | | |
|---|---|---|
| EP | 1146057 | * 10/2001 |
| EP | 0 888 440 B1 | 1/2003 |
| WO | WO 97/34987 | 9/1997 |
| WO | WO 02/064722 A2 | 8/2002 |

* cited by examiner

*Primary Examiner*—John R Hardee
(74) *Attorney, Agent, or Firm*—Morgan, Lewis & Bockius LLP

(57) ABSTRACT

Perfume compositions and method of formulating perfume composition are designed for use in wash-off system to provide either a desired initial release with minimal residual perfume on the targeted system, a long sustained release of fragrance, or a residual deposition of fragrance after use, based upon the odorants selected according to their mass transfer values, odor detection thresholds and/or calculated odor indices.

12 Claims, 6 Drawing Sheets

PERFUMES FOR RINSE-OFF SYSTEMS

CROSS-REFERENCE TO RELATED APPLICATIONS

Applicants claim priority benefits under 35 U.S.C. §119(e) of U.S. Provisional Patent Application Ser. No. 60/669,120 filed Apr. 7, 2005.

FIELD OF THE INVENTION

The present invention relates to perfume systems. More particularly, the present inventions relates to the optimization of perfumes used in high water dilution conditions and/or rinse off applications.

In addition, this invention relates to the design and engineering of a perfume using odorants' mass transfer properties in order to control the optimization and predicted progression and/or release of the fragrance hedonic profile with time in the presence of water.

BACKGROUND OF THE INVENTION

Fragrances are an important part of cosmetic compositions since their primary role is to create an agreeable sensory experience for the consumer, in addition to providing malodor coverage or other more functional roles.

Perfumes are composed of odorants with a wide range of molecular weights, vapor pressures and diffusivities as well as different polarities and chemical functionalities. Using these different properties, an individual skilled in the art could create different hedonic profiles describing the fragrance.

Fragrance materials are generally small molecular weight substances with a vapor pressure that allows their molecules to evaporate, become airborne, and eventually reach the olfactory organ of a living entity. There are a variety of different fragrance materials with different functional groups and molecular weights, both of which affect their vapor pressures, and hence, the ease with which they can be sensed.

Odorants used in perfumery offer a wide array of polarity ranging from the somewhat water miscible to the water immiscible chemical compounds. Perfumery in the various rinse-off applications spanning from cosmetic to industrial and household have different functionalities and must be engineered to fulfill certain needs and objectives. Perfumes' effect and quality during use plays a big role in the consumer's purchase intent as well and the desire of the consumer to purchase the product again.

For example, perfumery for dishwashing detergents must be engineered and designed not to leave any residual odor on the targeted surfaces (dishes) while providing the consumer an agreeable and impactful experience during the wash experience. On the other hand, perfumery for laundry systems must result in increased deposition of perfumes on the washed clothes.

Fragrances have been designed based upon the selection of odorants with certain properties. For instance, U.S. Pat. No. 6,143,707 directed to automatic dishwashing detergent discloses blooming fragrance compositions by which were chosen based on their clogP and boiling point values. Hydrophobicity is usually gauged by the clogP values of these odorants. The logP value of an odorant is defined as the ratio between its equilibrium concentration in octanol and in water. The logP value of many of the fragrance materials have been reported and are available in databases such as the Pomona92 database, the Daylight Chemical Information Systems, Inc, Irvine, Calif. The logP can also be very conveniently calculated using the fragment approach of Hansch and Leo. See A. Leo, Comprehensive Medicinal Chemistry, Vol 4, C. Hansch et al. p 295, Pergamon press, 1990. These logP values are referred to as clogP values. Odorants thought to result in bloom in water dilutions are thought to have clogP of at least 3.0 and boiling points of less than 26° C. The same rationale for dishwashing liquids with blooming perfumes is also disclosed in U.S. Patent Application Publication No. 2004/0138078. EP Patent No. 0888440B1 relates to a glass cleaning composition containing "blooming perfumes" based on criteria mentioned above. U.S. Pat. No. 6,601,789 discloses toilet bowl cleaning compositions also containing "blooming perfumes" made of odorants chosen based on their clogP values of at least 3.0 and boiling points of less that 260° C. Generally, odorants with delayed bloom are thought to have a clogP of less than 3.0 and boiling point values of less than 250 deg C.

While the above-mentioned references disclose methods of selecting odorants based upon the certain properties of the odoants, i.e. clogP and boiling point values, they do not encompass and identify all odorants which have superior release properties in heavy water dilutions. There remains a need in the art for fragrance compositions methods of formulating those compositions to achieve improved fragrance release in water based rinse-off systems.

SUMMARY OF THE INVENTION

A method of formulating a perfume composition for wash-off systems, comprising calculating values of odor detection threshold, odor detection threshold in air, acceleration (Γ), and flash water release (Ω) values for a group of odorants, selecting at least three different odorants based on these values and placing the perfume compostion in a wash-off system to provide either an initial water release and a minimal residual perfume on a targeted surface after wash-off, a long sustained perfume release and hedonic experience during the wash-off event, or a residual fragrance deposition, is provided.

A perfume composition for wash-off systems having either a desired initial water release and minimal residual perfume on a targeted surface after wash-off, a long sustained perfume release and hedonic experience during the wash-off event, or a residual fragrance deposition, comprising at least three different odorants selected based upon their acceleration (Γ) value, flash release, odor detection threshold and/or odor detection threshold in air, is provided.

DETAILED DESCRIPTION OF THE INVENTION

Figure 1:
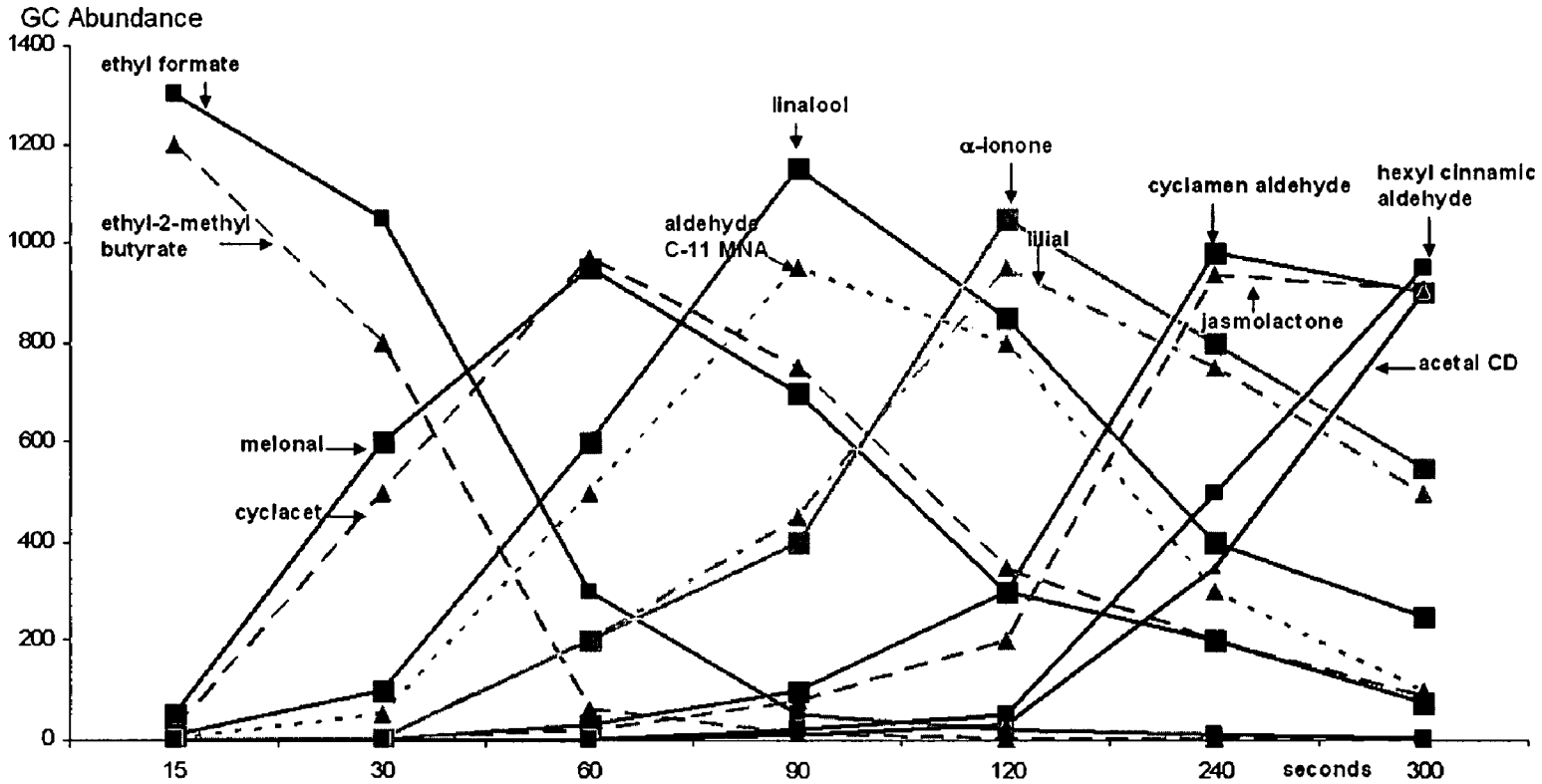
FIG. 1 is a graph of odorants' residence time in headspace according to their Γ values.

The general physical properties of perfume odorants as currently known in the art (e.g., U.S. Pat. No. 6,143,707 U.S. Patent Application Pub. No. 2004/0138078, EP Patent No. 0888440B1, and U.S. Pat. No. 6,601,789) do not provide a complete picture when creating perfumes for rinse-off systems. Odorants such as ethyl formate, ethyl acetoacetate, ethyl acetate, diethyl malonate, fructone, ethyl propionate, toluic aldehyde, leaf aldehyde, trans-2-hexenal, trans-2-hexenol, cis-3-hexenol, prenyl acetate, ethyl butyrate, hexanal, butyl acetate, 2-phenylpropanal, cis-4-heptenal, cis-3-hexenyl formate, propyl butyrate, amyl acetate, ethyl-2-methylbutyrate, ethyl amyl ketone, hexyl formate, 3-phenyl butanal, cis-3-hexenyl methyl carbonate, methyl phenyl carbinyl acetate, methyl hexyl ether, methyl cyclopentylidene acetate, 1-octen-3-ol, cis-3-hexenyl acetate, amyl vinyl carbinol, 2,4-dimethyl-3cyclohexen-1-carbaldehyde, ethyl 2-methylpentanoate, 1,3,3-trimethyl-2-oxabicyclo[2.2.2]octane, 3,7-dimethyl-7-methoxyoctan-2-ol etc. are considered by the authors of the herein invention to have superior release properties in heavy water dilutions. Yet, the above mentioned odorants are considered "delayed release" odorants according to the previously mentioned patents, which is counter to both empirical and experimental observations when used in wash-off products.

Furthermore, a direct relationship between the quantity of an odorant in a perfume and its ability to be released from the water partition under heavy water dilution is generally observed by perfumers skilled in the art. The opposite can also hold true when using very small amounts of an odorant in a perfume. Above mentioned patents do not account for the change in an odorant's ability to release or bloom due to its concentration or quantity. A mathematical relationship relating quantity of odorants in perfumes to their mass transfer properties needs to be established in order to predict the order of elution of perfume constituents when exposed to heavy water dilutions. For example, thiogeraniol (clogP 4.88, boiling point 250 deg C.) can have very delayed water release properties when used in parts per trillion in a perfume although considered a "blooming" material based on its physical properties, according to existing literature and above mentioned patents. By establishing a mathematical relationship with mass transfer properties, one can design and further improve water release hedonic perception of perfume materials. The result is the new optimization and applied perfumery for wash off applications.

U.S. Pat. No. 6,858,574 relates odorants release properties in heavy water dilution to a relationship with components of the formulation in which the perfume is delivered, more notably, the surfactant system. The so-called perfume burst index (PBI) is defined by:

$$PBI = \frac{\phi - 1.4/CMC}{K}$$

where Φ is water/oil partition coefficient (an equivalent to clogP mentioned above), K is the volatility constant of perfumes in air (in direct relationship to boiling point values) and CMC is the critical micellization concentration of the surfactant systems (wt/wt). A burst release in water dilutions is thought to happen when there is at least 20% increase of the odorant in headspace. Examples provided by the author are done in dilutions not exceeding 60 and mostly between 0 and 30. Yet, in consumer usage of formulations in wash off conditions, especially in applications such as body wash, conditions, shampoos, and surface cleaners, the conditions far exceed the dilution values used in U.S. Pat. No. 6,858,574 for the calculations. For example, a typical usage of water during a shower exceeds 25 gallons of water and can reach 50 gallons of water when considering a typical household shower pressure dispensing 5-10 gallons a minute (See http://www.engr.uga.edu/service/extension/publications/c819-1.html). Values for water dilutions in a typical household, cosmetic, industrial wash-off application therefore far exceeds the dilution values used in U.S. Pat. No. 6,858,574. One can therefore argue that under these extreme dilution conditions of a typical wash-off application (1/100 and above), the release partitions become essentially water, water-air and air, with surfactants' contributions very minimal, almost non existent.

In the present invention, mass transfer properties of odorants in water as well as their odor detection thresholds determined either experimentally or theoretically are used to design fragrances optimized for water release. The above-mentioned physico-chemical properties of odorants are utilized in methods described in this invention to control and engineer superior olfactive perception of these perfumes during their use and release in the presence of water with resulting effects required by the wash-off applications in which they are delivered. According to the present invention, a perfume composition is optimized for various cosmetic, household and industrial applications in water systems and/or in presence of water. These perfumes comprise about 30% or more of the estimated total fragrance odor impact within specifically designated water release groupings as defined in the present invention, depending on the applications considered and described herein.

The perfumes of this invention are also designed to potentially give the consumer the perception of sustained and more prolonged release during wash-off, or initial burst of perfume without residual perfume left behind on a surface upon completion of the wash-off experience or a substantive deposition on a chosen surface at the end of a wash-off cycle depending on the applications and the engineered perfume designed according to the methods described in this invention.

This invention deals primarily with the optimization of fragrance diffusion and behavior in high water dilutions based on calculated mass transfer and transport properties of odorants in water, water vapor and air partitions according to methods described herein.

The object of this patent is to improve fragrance perception during delivery or release in presence of large volumes of water.

In water-based systems, choosing fragrance molecules based on specific mass-transfer values for release out of a matrix optimizes the perfume's intensity and perceived hedonic quality. These values are calculated according to these odorants' physico-chemical properties based on principles of mass transfer.

Water Release, Ω

Water release value (Ω) is defined by the authors as being the product of quantity of an odorant in a perfume totaling 100 parts, flux (Φ), pseudo-acceleration (Γ) of odorants out of the water partition. These Ω values are used to separate the fragrance into water release groups, therefore predicting the chronological elution of odorants out the water, water/air into the air partitions.

$$\Omega.\Phi.\Gamma$$

Within these defined water-release groups, odorants are then further described based on their experimentally determined odor detection thresholds (ODT) and/or theoretically calculated odor indices (O.I.) to further characterize the odor impact or olfactive intensity along with the hedonic type of the released group of odorants.

Based on the application considered, the perfume considered will be optimized using different groups of odorants based on their mass transfer values within the total perfume formula. These defined release groups for water partitions, defined in more details in the invention, are used to construct fragrances for different hedonic and effects according to the applications targeted.

Perfumes designed for surface cleaners and dishwashing detergents are composed of at least 30%, preferably at least 40% of total perfume odorants with characteristic flash water release values, (Γ values more than 1000. These odorants must elute within "water release groups" 1, 2 and 3, based on the odorants' water release values Ω as calculated according to methods set forth in this invention. Intensity of the released fragrance will also be based on odor detection threshold values and/or the correlated "odor indices", a measure of odor intensity directly related to odor detection thresholds. Therefore, at least three of the perfume's flash release odorants must have odor detection threshold in water less than 50 parts per billion and/or odor detection thresholds in air of less than 0.025 mg/m$^3$. Quantity and odor detection threshold value and/or correlated 'odor indices' of odorants in water release groups 4, 5, and 6 are proportionally minimized. Perfumes constructed according to the above set parameters will not be significantly residual on the targeted surfaces (dish surface, glass etc.) but will result in a good hedonic experience during release.

Perfumes engineered for shampoos, conditioners, body wash etc. will on the other hand be optimized using primarily sustained release odorants based on the optimal residence time in headspace. Fragrances constructed with at least 30% and preferably at least 40% of odorants with acceleration values for sustained release (Γ values between 1000 and 100). These sustained release odorants must elute within water release groups 1, 2, 3 and 4 according to their Ω values, resulting in a more sustained, well rounded long lasting hedonic experience to the consumer during a rinse-off experience. In addition, at least three of the perfume's flash release odorants must have odor detection threshold in water less than 50 parts per billion and/or odor detection thresholds in air of less than 0.025 mg/m$^3$.

Finally, more residual fragrances for wash-off applications such as laundry can be engineered based on a majority of fragrance at least 40%, preferably 50% of odorants, referred to by the authors as "deposition odorants," based on their mass transfer properties.

According to the present invention, perfumes designed for wash-off systems with a desired initial water release and minimal residual perfume on a targeted surface after wash-off, will contain at least three different odorants with odor detection thresholds of 50 parts per billion or less and/or odor detection threshold in air of less than 0.025 mg/m$_3$, making up at least 30%, preferably more than 40% of the perfume's constituents. These above mentioned odorants must have flash release properties: Γ values more than 1000 and must be within water release groups 1 and/or 2 and/or 3, according to methods set forth in the herein patent.

In another aspect of the present invention, perfumes for wash-off systems engineered for a long sustained hedonic experience to the consumer during the wash-off event must have at least three different odorants with odor detection thresholds of 50 parts per billion or less and/or odor detection thresholds in air of less than 0.025 mg/m$^3$, and Γ values for sustained release between 1000 and 100. These so-called sustain release odorants must constitute at least 30%, preferably at least 40% of the total perfume components and must elute between water release groups 1 and/or 2 and/or 3 and/or 4 based on their water release values: Ω.

In yet another aspect of the present invention, perfumes intended for deposition in wash-off systems must have at least 40% and preferably more than 50% of their components with "residual" physical properties or deposition properties in water as set forth in this invention: Γ less than 100.

In addition, the so-called residual odorants must contain at least three different odorants with odor detection threshold values in water of 50 parts per billion or less and/or odor detection thresholds in air of less than 0.025 mg/m$^3$. These so-called "residual" odorants must also be released within water release groups 4 and/or 5 and/or 6, based on their water release values Ω.

Water based formulations are usually oil in water or water in oil emulsions with a varied concentration of water. By emulsifying these partitions, fragrances are dispersed and solubilized. Upon heavy water dilutions typical for the average household, industrial and cosmetic use, odorants making up perfumes need to diffuse through what is considered to be mostly water, a vapor phase above the liquid phase and finally the air phase.

Water Release Value, Ω

To increase the water release impact of these fragrances in these systems, properties of odorants based on their mass transfer characteristics were used. These odorants' release properties in water ($\Omega_{1,2}$) will determine the order of elution of these odorants in the partitions considered: water, water-air and air $$\Omega = n\Phi\cdot\Gamma \qquad [1]$$

Φ=Flux of odorant in a system considering the partitions: water, water-air and air expressed in $$\frac{\text{mg}}{\text{cm}^2\times\text{sec}}$$

and Γ=Pseudo-acceleration factor of odorant in water, water-air and air expressed in $$\frac{\text{cm}}{\text{sec}^2},$$

n is the parts quantity of an odorant in a total 100 parts of a perfume.

This value of water release is indicative of the chronological order of elution of the odorants involved in the composition of the perfume diluted in water. As discussed later in this document, it is intimately linked to various thermodynamic and calculated mass transfer properties obtained by the authors but also based on quantity of the odorant considered within the entire formula.

Below is the description of the terms used to derive equation [1].

Flux ($\Phi_{12}$)

Flux of an odorant in partitions water, water-air and air, (Φ) is defined as the ratio of the quantity of odorant being transferred in the media considered divided by the time and area of the contained medium. Flux values can also be defined in relation to a concentration gradient of the odorant throughout a partition according to:

$$\Phi_{12} = -D_{12}\left(\frac{d(c_1)}{dz}\right) \quad [2]$$

$D_{12}$ is the diffusion constant of odorant (1) in partition (2) and $$\left(\frac{d(c_1)}{dz}\right)$$

is the concentration gradient of odorant (1) throughout the partition.

$D_{12}$ is calculated using the "Slattery Kinetic Theory" with non-polar odorants using odorants' critical parameters, unsteady state evaporation and measurement of binary diffusion coefficient. (Chem. Eng. Sci. 52, 1511-1515). The concentration gradients of the odorants composing the perfumes throughout the partitions considered (water, water-air and air) are calculated by solving for the dimensionless velocity value determined using the Arnold equation. (See Arnold, J. H. Studies in Diffusion: III. Unsteady State Vaporization and Absorption. Trans. Am. Inst. Chem Eng., 40, 361-378.). Some flux values for a variety of odorants out of a water partition are listed in the Table 1 below.

TABLE 1

Examples of flux values for some perfume odorants.

| Odorant | $\Phi$ (mg/cm$^2$ · sec) |
|---|---|
| Ethyl 2-methylbutyrate | 0.004361536 |
| d-1-Methyl-4-isopropenyl-1-cyclohexene | 0.001571820 |
| 2,2-Dimethyl-3-(p-ethylphenyl)propanal | 0.000006157 |
| 4-Methyl-3-decen-5-ol | 0.000004491 |
| 5-Hexyldihydro-2(3H)-furanone | 0.000005070 |
| 1-(5,5-Dimethyl-1-cyclohexen-1-yl)-pent-4-en-1-one | 0.000005501 |
| 6,6-Dimethyl-2-methylenebicyclo-(3.1.1)-heptane | 0.001912106 |
| 6-sec-Butylquinoline | 0.000006754 |
| Octahydro-4,7-methano-1H-indene-5-yl acetate | 0.000009115 |
| Ethyl 2,3-epoxy-3-methyl-3-phenylpropionate | 0.000010182 |
| 2(6)-methyl-8-(1-methylethyl)-bicyclo[2.2.2] octe-5-en-2(3)-yl-1,3-dioxolane | 0.000003792 |
| Isopropyl-methyl-2-butyrate; | 0.002632239 |
| Tricyclo-decenyl propionate | 0.000003150 |
| 2,6,10-Trimethyl-9-undecenal | 0.000001843 |
| Methyl-2-hexyl-3-oxocyclopetanedecarboxylate | 0.000000204 |
| 2-Phenylethyl phenylacetate | 0.000000080 |
| 3,7-Dimethyl-1,6-octadien-3-yl 3-phenyl-2-propenoate | 0.000000039 |
| Ethyl octyne carbonate | 0.000007735 |
| 3,7-Dimethyl-2,6-octadien-1-thiol | 0.000046576 |
| (1R-(1a,4b,4aa,6b,8aa))-Octahydro-4,8a,9,9-tetramethyl-1,6-methano-1(2H)-naphtol | 0.000001119 |

Pseudo-Acceleration, $\Gamma_{12}$

In the analysis of the volatility of odorants, several variables are found to be important. First, the vapor pressure of the odorant is an important measure of its volatility. The product of the odorant's activity coefficient $\gamma$ in the partition its mole fraction X and its pure vapor pressure value $P_v$, gives the odorant's relative vapor pressure. A second important factor for volatility is the diffusivity $D_{12}$ of the odorant in the considered media: water, vapor phase and subsequently air.

Other important variables to consider are the molecular weight $M_w$, of the odorant and its density in the partition $\rho_l$ and in the solvent vapor state $\rho_v$. The final variable to consider is an energy parameter in the partition state. The energy difference $\epsilon_{12}=\epsilon_{12(polar)}-\epsilon_{12o(non\text{-}polar)}$ is proportional to the partition coefficient of an odorant in a polar solvent such as water, and a water immiscible solvent such as octanol, benzene and paraffin liquid. The energy $\epsilon_{12}$ is called the partition energy and can be correlated to the clogP value of odorants. By definition: clogP proportional to $(\epsilon_{12(water)}-\epsilon_{12(octanol)})/R*T$; R=1.987 cal/(mole−° K); T=temperature (kelvin).

The five variables $D_{12}$, $P_v$, Mw, $\rho_v$. and $\epsilon_{12}$ and the three dimensional variables indicate that there can be 5−3=2 dimensional variables which describe Newton's law. The easiest separation is to break the acceleration vector into 2 dimensional quantities: a frequency or first order rate constant (1/time) and a velocity (distance/time) term.

The velocity group can be formed from the vapor pressure and density. Since pressure has units of mass*distance/distance$^2$*time$^2$, and density has units of mass/distance$^3$, the ratio of the two has units of velocity squared. The square root gives the desired velocity.

The first order rate constant can be formed from the variables Mw, $D_{12}$ and $\epsilon_{12}$. Since the partition energy $\epsilon_{12}$ has dimensions of calories per mole (mass.length$^2$/mole.time$^2$) and the diffusivity coefficient $D_{12}$ has a dimension of distance$^2$ per time, the ratio yields exactly a molecular weight unit per time t. The energy can be made dimensionless by dividing by the gas constant k and temperature T. The remaining variable $D_{12}$ can be made to a frequency by dividing by a cross sectional area $L^2$. A molecular area calculated from the liquid molar volume could represent this area.

Some $\Gamma$ values for a variety of odorants are listed below in Table 2.

TABLE 2

Calculated pseudo-acceleration values for some perfume odorants

| Odorant | $\Gamma$ (cm/sec$^2$) |
|---|---|
| Ethyl 2-methylbutyrate | 12827.56 |
| d-1-Methyl-4-isopropenyl-1-cyclohexene | 8200.76 |
| 2,2-Dimethyl-3-(p-ethylphenyl)propanal | 121.17 |
| 4-Methyl-3-decen-5-ol | 116.38 |
| 5-Hexyldihydro-2(3H)-furanone | 115.36 |
| 1-(5,5-Dimethyl-1-cyclohexen-1-yl)-pent-4-en-1-one | 109.12 |
| 6,6-Dimethyl-2-methylenebicyclo-(3.1.1)-heptane | 9007.51 |
| 6-sec-Butylquinoline | 135.34 |
| Octahydro-4,7-methano-1H-indene-5-yl acetate | 144.06 |
| Ethyl 2,3-epoxy-3-methyl-3-phenylpropionate | 147.67 |
| 2(6)-methyl-8-(1-methylethyl)-bicyclo[2.2.2] octe-5-en-2(3)-yl-1,3-dioxolane | 57.74 |
| Isopropyl-methyl-2-butyrate; | 8722.05 |
| Tricyclo-decenyl propionate | 60.58 |
| 2,6,10-Trimethyl-9-undecenal | 43.58 |
| Methyl-2-hexyl-3-oxocyclopetanedecarboxylate | 6.71 |
| 2-Phenylethyl phenylacetate | 2.29 |
| 3,7-Dimethyl-1,6-octadien-3-yl 3-phenyl-2-propenoate | 0.71 |
| Ethyl octyne carbonate | 156.29 |
| 3,7-Dimethyl-2,6-octadien-1-thiol | 659.09 |
| (1R-(1a,4b,4aa,6b,8aa))-Octahydro-4,8a,9,9-tetramethyl-1,6-methano-1(2H)-naphtol | 25.57 |

Pseudo acceleration values are also closely linked to the ability of an odorant to travel through headspace once it is airborne in addition to its ability to migrate through the water and water-air partitions. This value is predictive of what the authors consider "flash release", "sustained release" and "deposition" of odorants in heavy water dilutions.

"Flash release" is defined as fast migration through water and subsequent very low residence time in headspace, resulting in a short hedonic experience of initial release and very minimal deposition on a treated surface. "Sustained release" is characterized by good water release properties along with a longer residence time in the water vapor and subsequently, the air phase. "Deposition" is a term used to categorize odorants with very poor water/air release properties and consequently remain available for superior deposition on the surfaces treated.

Flash release odorants are considered by the authors to have acceleration, Γ values above 900 cm/sec$^2$, sustained release odorants are thought to have Γ values between 900 and 100 and finally deposition odorants have acceleration values of less than 100.

As an illustration, some odorants with characteristic acceleration values for all three release categories defined by the authors are shown below. Water release properties are observed in 1 to 100 water dilution of a typical formulation containing these odorants as shown in the following procedure. The odorants chosen for this illustrative example are as follow in Table 3.

TABLE 3

Release properties and predicted residence time for some perfume odorants.

| | | Γ (acceleration water/air) |
|---|---|---|
| Flash Release | ethyl formate | 46183.23 cm/sec$^2$ |
| | ethyl-2-methyl butyrate | 12827.56 |
| | melonal | 2655.52 |
| | cyclacet | 1687.87 |
| Sustained Release | linalool | 644.41 |
| | aldehyde c-11 moa | 401.44 |
| | alpha ionone | 283.60 |
| | lilial | 104.63 |
| Deposition Odorants | cyclamen aldehyde | 99.64 |
| | jasmolactone | 76.30 |
| | hexyl cinnamic aldehyde | 21.01 |
| | acetal cd | 0.08 |

Experimental Procedure:

Individual odorant to be tested was added to 20 g of shampoo formulation (see formula below in Table 4) at 0.1%.

TABLE 4

House Shampoo Formulation

| Phases | Ingredients | Supplier | Percent |
|---|---|---|---|
| A | D. I. Water | | 35.00 |
| A | Standapol ES-2 | Cognis Corp. | 35.00 |
| B | Standapol WAQ-LC | Cognis Corp | 27.50 |
| B | Glydant 2000 | Lonza | 0.30 |
| C | Sodium Chloride | | 1.80 |

A 10 gram sample of formulation and fragrance was added to an empty 1000 ml pyrex beaker. This beaker was then filled with 1000 ml of 120 F tap water. Beaker with diluted shampoo sample was then immediately placed into a semi-enclosed plexiglass chamber.

Headspace Sampling: Once beaker was placed into chamber a Carboxan SPME field fiber was held at the top-side opening of the chamber over the beaker containing the sample. At 15 seconds, the fiber was released and the headspace emissions from the beaker were collected. Headspace emissions from beaker were collected at 15, 30, 60, 90, 120, 240 and 300 seconds using a different Carboxan-PDMS field fiber for each sampling time. Top of plexiglass chamber was held open for entire 5 minutes of headspace sampling.

Each Carboxan-PDMS SPME Field Fiber that was used for each of the seven above sampling time intervals was then desorbed on a Hewlett Packard HP6890 GC/5973 Mass Selective Detector System.

The partition release value Ω is defined as the product of the pseudo acceleration Γ and the flux value Φ and the quantity of odorant in a total 100 parts of the perfume diluted in water. The units of Ω are $$\left(\frac{\text{mg}\cdot\text{cm}}{\text{cm}^2\cdot\text{sec}^2}\right)\cdot\frac{1}{\text{sec}}.$$

The expression of water release out of the water, water-air and air partitions can then be physically equated to a value of $$\left(\frac{\text{Force}}{\text{Area}}\right)\times\frac{1}{\text{sec}}$$

or in other words, units of pressure per time out partition. It is important to establish that water release values are indicative of the order of elution of odorants in a perfume out the partitions considered into headspace when subject to extreme aqueous dilutions. It is indicative of how fast in time will an odorant start to appear in time.

This predictive value for elution time allows a person skilled in the art to establish groupings of odorants eluting from the water dilutions, constructing therefore keys or hedonic profile and achieving better engineering control of their creative process. By engineering these groupings of odorants and their order of elution, a perfumer can construct optimized perfumes for water release systems, since most of these odorants will behave differently in aqueous dilutions as compared to emulsions with various surfactant proportions.

Water release values, Ω for the corresponding odorants is an indication of the time it will take before it appears in headspace when diluted in water. Once in headspace, acceleration values as well as odor detection thresholds (discussed in more details further) will dictate the intensity and odor contribution as well as residence time of odorants in the water vapor and air. The following relationships were empirically established by the authors for elution time of odorants in heavily diluted aqueous media based on Ω values in Table 5.

TABLE 5

Water Release Groups Definitions.

| | Water Release Values | Time of elution |
|---|---|---|
| Water Release Group 1 | $\Omega \geqq 10$ | Upon dilution: t = 0 seconds |
| Water Release Group 2 | $10 > \Omega \geqq 0.07$ | 0 to 10 seconds |
| Water Release Group 3 | $0.07 > \Omega \geqq 0.007$ | 0 to 20 seconds |
| Water Release Group 4 | $0.007 > \Omega \geqq 0.0005$ | 0 to 30 seconds |
| Water Release Group 5 | $0.0005 > \Omega \geqq 0.00003$ | 0 to 45 seconds |
| Water Release Group 6 | $0.00003 > \Omega$ | 0 to 60 seconds |

As an illustration, the below "Tropical Fruit" perfume release profile shown in Table 6 was observed in aqueous dilution of 1/100 using headspace GC-MS method at 1% in a house shampoo formulation (see formulation above).

The perfume's components are grouped in the predicted water release groups (1 to 6) according to the Ω values above along with the predicted time of elution (t) from the diluted aqueous/air partitions.

TABLE 6

| Tropical Fruit Perfume | parts | Ω |
|---|---|---|
| Predicted Water Release Group 1 [t = 0 seconds] | | |
| d-LIMONENE | 2 | 25.7802389895 |
| Predicted Water Release Group 2 [t less than 10 seconds] | | |
| ETHYL BUTYRATE | 0.1 | 7.0552312843 |
| ETHYL 2-METHYLBUTYRATE PURE FCC | 0.1 | 5.5947876874 |
| TRIPLAL | 0.3 | 4.1970000000 |
| MANZANATE | 0.1 | 0.5903646696 |
| LINALOOL | 9 | 0.2769314405 |
| DIHYDROMYRCENOL | 3 | 0.1905945812 |
| Predicted Water Release Group 3 [t less than 20 seconds] | | |
| ROSE OXIDE (HIGH CIS) | 0.1 | 0.0584040169 |
| CIS-3-HEXEN-1-OL | 0.2 | 0.0513223980 |
| BENZYL ACETATE | 1.3 | 0.0511546620 |
| CITRONELLOL AJ, FCC | 0.7 | 0.0405549107 |
| VERDOX | 2.5 | 0.0242936469 |
| ALLYL HEPTOATE | 0.5 | 0.0216167817 |
| ALDEHYDE C-18 | 0.5 | 0.0209445281 |
| CIS-3-HEXENYL ACETATE | 0.1 | 0.0180243127 |
| ETHYL LINALOOL | 2.9 | 0.0121483853 |
| BENZYL PROPIONATE | 0.5 | 0.0114915690 |
| FRUCTONE | 0.3 | 0.0103951730 |
| LIFFAROME | 0.1 | 0.0102830404 |
| DIHYDROLINALOOL | 0.2 | 0.0071934130 |
| Predicted Water Release Group 4 [t less than 30 seconds] | | |
| IONONE BETA PURE | 0.9 | 0.0066027260 |
| DIMETHYL BENZYL CARBINYL ACETATE | 1 | 0.0044592702 |
| VERTENEX HC | 0.1 | 0.0011211319 |
| TERPINYL ACETATE | 0.1 | 0.0010096117 |
| Predicted Water Release Group 5 [t less than 45 seconds] | | |
| FLOROL | 2.5 | 0.0004707520 |
| TERPINEOL | 0.1 | 0.0004502877 |
| OXANE | 0.01 | 0.0003278790 |
| UNDECAVERTOL | 0.6 | 0.0003136174 |
| FLORHYDRAL | 0.3 | 0.0002988038 |
| ALLYL CYCLOHEXYL PROPIONATE | 0.3 | 0.0002838164 |
| HEXYL CINNAMIC ALDEHYDE | 15 | 0.0002445428 |
| GAMMA-DECALACTONE | 0.3 | 0.0001754522 |
| GAMMA UNDECALACTONE | 0.3 | 0.0001426688 |
| alpha-DAMASCONE | 0.1 | 0.0001360916 |
| MAGNOLAN/CORPS 719 | 3 | 0.0001281900 |
| HELIONAL | 1.4 | 0.0000393253 |
| ADOXAL | 0.4 | 0.0000321258 |
| BENZYL ALCOHOL | 0.2 | 0.0000319302 |
| BACDANOL | 1.5 | 0.0000316677 |
| Predicted Water Release Group 6 [t less than 60 seconds] | | |
| HEDIONE | 15 | 0.0000209666 |
| SANDALORE | 1.3 | 0.0000177176 |
| DAMASCENONE | 0.03 | 0.0000147507 |
| GALAXOLIDE 50 IPM | 5 | 0.0000144162 |
| CALONE | 0.03 | 0.0000057982 |
| AMBROXAN | 0.03 | 0.0000012314 |
| ETHYLENE BRASSYLATE | 4.3 | 0.0000012189 |
| OXANONE CRYSTALS | 0.4 | 0.0000010442 |
| VERTOFIX COEUR | 0.1 | 0.0000004524 |
| EXALTOLIDE TOTAL | 0.2 | 0.0000002980 |
| METHYL ATRATATE | 0.1 | 0.0000000003 |
| | 79.1 | |
| propylene glycol | 20.9 | |
| total perfume | 100 | |

Below, in Table 7 are the experimental results for the release profile in time (0 to 60 seconds) of the Tropical Fruit Perfume in 1/100 dilution in water using GC-MS headspace analysis.

TABLE 7

| | GC Abundance |
|---|---|
| 5 seconds | |
| d-LIMONENE | 7000 |
| 10 seconds | |
| d-LIMONENE | 7000 |
| ETHYL 2-METHYLBUTYRATE | 3000 |
| ETHYL BUTYRATE | 2800 |
| TRIPLAL | 1000 |
| MANZANATE | 1000 |
| LINALOOL | 500 |
| DIHYDROMYRCENOL | 500 |
| 20 seconds | |
| d-LIMONENE | 7000 |
| TRIPLAL | 14000 |
| ETHYL BUTYRATE | 2800 |
| ETHYL 2-METHYLBUTYRATE PURE FCC | 3100 |
| MANZANATE | 4000 |
| LINALOOL | 18000 |
| DIHYDROMYRCENOL | 15000 |
| ROSE OXIDE (HIGH CIS) | 10000 |
| CIS-3-HEXEN-1-OL | 14000 |
| BENZYL ACETATE | 12000 |
| CITRONELLOL AJ,FCC | 7000 |
| VERDOX | 5000 |
| ALLYL HEPTOATE | 4000 |
| ALDEHYDE C-18 | 2000 |
| CIS-3-HEXENYL ACETATE | 5000 |
| ETHYL LINALOOL | 5000 |
| BENZYL PROPIONATE | 2000 |
| FRUCTONE | 3000 |
| LIFFAROME | 3000 |
| DIHYDROLINALOOL | 3000 |
| 30 seconds | |
| d-LIMONENE | 7000 |
| TRIPLAL | 14000 |
| ETHYL BUTYRATE | 2800 |
| ETHYL 2-METHYLBUTYRATE PURE FCC | 3100 |
| MANZANATE | 4000 |
| LINALOOL | 18000 |
| DIHYDROMYRCENOL | 15000 |
| ROSE OXIDE (HIGH CIS) | 14000 |
| CIS-3-HEXEN-1-OL | 14000 |
| BENZYL ACETATE | 17000 |
| CITRONELLOL AJ,FCC | 7000 |
| VERDOX | 14000 |
| ALLYL HEPTOATE | 10000 |
| ALDEHYDE C-18 | 2000 |
| CIS-3-HEXENYL ACETATE | 14000 |
| ETHYL LINALOOL | 10000 |
| BENZYL PROPIONATE | 6000 |
| FRUCTONE | 5000 |
| LIFFAROME | 3000 |
| DIHYDROLINALOOL | 3000 |
| IONONE BETA PURE | 2000 |
| DIMETHYL BENZYL CARBINYL ACETATE | 2000 |
| VERTENEX HC | 2000 |
| TERPINYL ACETATE | 1000 |
| 40 seconds | |
| d-LIMONENE | 5000 |
| TRIPLAL | 10000 |
| ETHYL BUTYRATE | 2000 |
| ETHYL 2-METHYLBUTYRATE PURE FCC | 2000 |
| MANZANATE | 3000 |
| LINALOOL | 18000 |
| DIHYDROMYRCENOL | 15000 |
| ROSE OXIDE (HIGH CIS) | 14000 |
| CIS-3-HEXEN-1-OL | 14000 |
| BENZYL ACETATE | 18000 |

TABLE 7-continued

| | GC Abundance |
|---|---|
| CITRONELLOL AJ,FCC | 7000 |
| VERDOX | 18000 |
| ALLYL HEPTOATE | 12000 |
| ALDEHYDE C-18 | 4000 |
| CIS-3-HEXENYL ACETATE | 14000 |
| ETHYL LINALOOL | 10000 |
| BENZYL PROPIONATE | 6000 |
| FRUCTONE | 5000 |
| LIFFAROME | 3000 |
| DIHYDROLINALOOL | 3000 |
| IONONE BETA PURE | 10000 |
| DIMETHYL BENZYL CARBINYL ACETATE | 8000 |
| VERTENEX HC | 8000 |
| TERPINYL ACETATE | 9000 |
| FLOROL | 10000 |
| TERPINEOL | 10000 |
| OXANE | 2000 |
| UNDECAVERTOL | 10000 |
| FLORHYDRAL | 9000 |
| ALLYL CYCLOHEXYL PROPIONATE | 7000 |
| HEXYL CINNAMIC ALDEHYDE | 2000 |
| GAMMA-DECALACTONE | 4000 |
| GAMMA UNDECALACTONE | 4000 |
| alpha-DAMASCONE | 1000 |
| MAGNOLAN/CORPS 719 | 1000 |
| HELIONAL | 500 |
| ADOXAL | 300 |
| BENZYL ALCOHOL | 50 |
| BACDANOL | 100 |
| 50 seconds | |
| d-LIMONENE | 4000 |
| TRIPLAL | 6000 |
| ETHYL BUTYRATE | 800 |
| ETHYL 2-METHYLBUTYRATE PURE FCC | 1500 |
| MANZANATE | 1500 |
| LINALOOL | 18000 |
| DIHYDROMYRCENOL | 15000 |
| ROSE OXIDE (HIGH CIS) | 14000 |
| CIS-3-HEXEN-1-OL | 14000 |
| BENZYL ACETATE | 18000 |
| CITRONELLOL AJ,FCC | 7000 |
| VERDOX | 20000 |
| ALLYL HEPTOATE | 12000 |
| ALDEHYDE C-18 | 4000 |
| CIS-3-HEXENYL ACETATE | 14000 |
| ETHYL LINALOOL | 10000 |
| BENZYL PROPIONATE | 6000 |
| FRUCTONE | 5000 |
| LIFFAROME | 3000 |
| DIHYDROLINALOOL | 3000 |
| IONONE BETA PURE | 18000 |
| DIMETHYL BENZYL CARBINYL ACETATE | 8000 |
| VERTENEX HC | 10000 |
| TERPINYL ACETATE | 9000 |
| FLOROL | 15000 |
| TERPINEOL | 15000 |
| OXANE | 2000 |
| UNDECAVERTOL | 10000 |
| FLORHYDRAL | 10000 |
| ALLYL CYCLOHEXYL PROPIONATE | 10000 |
| HEXYL CINNAMIC ALDEHYDE | 9000 |
| GAMMA-DECALACTONE | 7000 |
| GAMMA UNDECALACTONE | 7000 |
| alpha-DAMASCONE | 5000 |
| MAGNOLAN/CORPS 719 | 3000 |
| HELIONAL | 5000 |
| ADOXAL | 3000 |
| BENZYL ALCOHOL | 100 |
| BACDANOL | 5000 |
| GALAXOLIDE 50 IPM | 1000 |
| HEDIONE | 4000 |
| SANDALORE | 2000 |
| DAMASCENONE | 1000 |
| CALONE | 1000 |
| AMBROXAN | 1000 |
| ETHYLENE BRASSYLATE | 20 |

TABLE 7-continued

| | GC Abundance |
|---|---|
| OXANONE CRYSTALS | 70 |
| VERTOFIX COEUR | 50 |
| EXALTOLIDE TOTAL | 50 |
| METHYL ATRATATE | 50 |

Odorants making up the perfume eluted in a 1/100 water dilution as predicted by their calculated Ω values. For example, when considering the first 20 seconds of the release profile of the diluted perfume, the inventors predicted d-limonene to elute first based on its Ω value (Water Release Group 1). The headspace experiment confirmed the above calculated prediction.

The next group of odorants predicted to elute from the diluted partition (Water Release Group 2) was made of: triplal, ethyl butyrate, ethyl-2-methyl butyrate, manzanate, linalool and dihydromyrcenol at time less than 10 seconds. This second "wave" of released odorants will enter the headspace above the aqueous dilution in a background of "d-limonene", a flash release citrus note released earlier. This assumption was again validated by the experimental GC-MS headspace experiment.

The third group of odorants predicted to elute at time less than 20 seconds was expected to be rose oxide, cis-3-hexenol, benzyl acetate, citronellol, verdox, allyl heptoate, aldehyde C-18, cis-3-hexenyl acetate, ethyl linalool, benzyl propionate, fructone, liffarome and dihydrolinalool based on their Ω values. In the background, odorants making up water release groups 1 and 2 are present. This theoretical prediction is again validated by the GC MS headspace experimental data. All other odorants making up the subsequent release profile of the perfume are also accurately predicted based on odorants' W values as shown in the experimental data above. A person skilled in the art can, as a result use the invention to engineer the perceived progression of the fragrance in time as it is liberated from the aqueous dilution.

Odor Detection Thresholds

Upon their release in headspace, odorants are detected based on their odor detection threshold values. Odor detection thresholds are defined as the lowest concentration of odorants in a selected medium (air or water) to be detected. By including odor index values of odorants in the model, one can further improve on the values for predicted performance of once odorants are released from the partition into the air.

It is also important to construct the fragrance with a balanced olfactive intensity in order not to overwhelm the consumer or to be aesthetically unappealing. Constructing each segment for the targeted application or intended effect must be based on balanced impact in accordance to these ODT values while at the same time answering to certain rules to give a well-rounded experience to the consumer.

Various databases for experimental odor detection threshold values in various partitions such as water and air are available. See Compilation of Odor and Taste Threshold Values Data, American Society for Testing and Materials, F. A. Fazzalari Editor; Booleans Aroma Chemical Information Service (BACIS))

In this invention, Odor Index (O.I.) values are calculated theoretically for odorants in air. These odor index values show a strong correlation with experimental odor detection thresholds in air and in water.

An example of how the inventors calculate mathematically these odor indices, the conformation of 1-undecanal deduced from docking experiments into $hOBP_{IIa}$ is used below.

a. Modeling of $hOBP_{IIa\alpha}$ Binding Site and Odorant Docking Experiments

Figure 2:
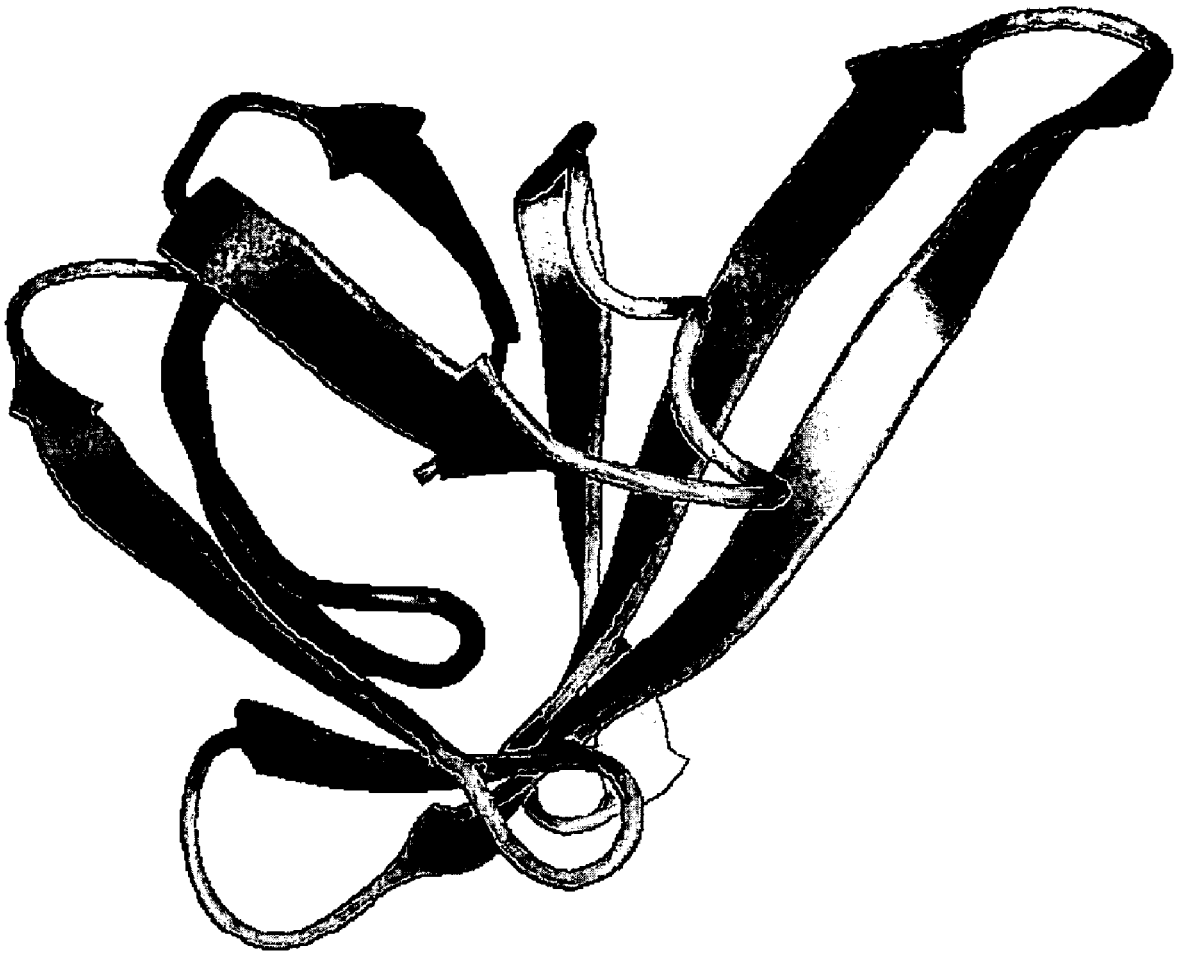
FIG. 2 is the predicted tertiary structure for $hOBP_{Пα}$.

Human odorant binding protein $hOBP_{IIa\alpha}$ (17.8 kDa), belongs to the Lipocalin family. The amino acid sequence is 45.5% similar to the rat $OBP_{II}$ and 43% similar to the human tear lipocalin (TL-VEG). The tertiary structure of $hOBP_{IIa\alpha}$ was obtained using the automated SWISS-MODEL protein modeling service (http://swissmodel.expasy.org/). The modeled structure along with the modeled protein binding site is shown below in FIG. 2. The eight-stranded β-barrel, a common motif for lipocalins is present as well as two alpha helices (as also predicted by Lacazette et al., Human Molecular Genetics, 2000, 9, 2, 289-301).

Figure 3:
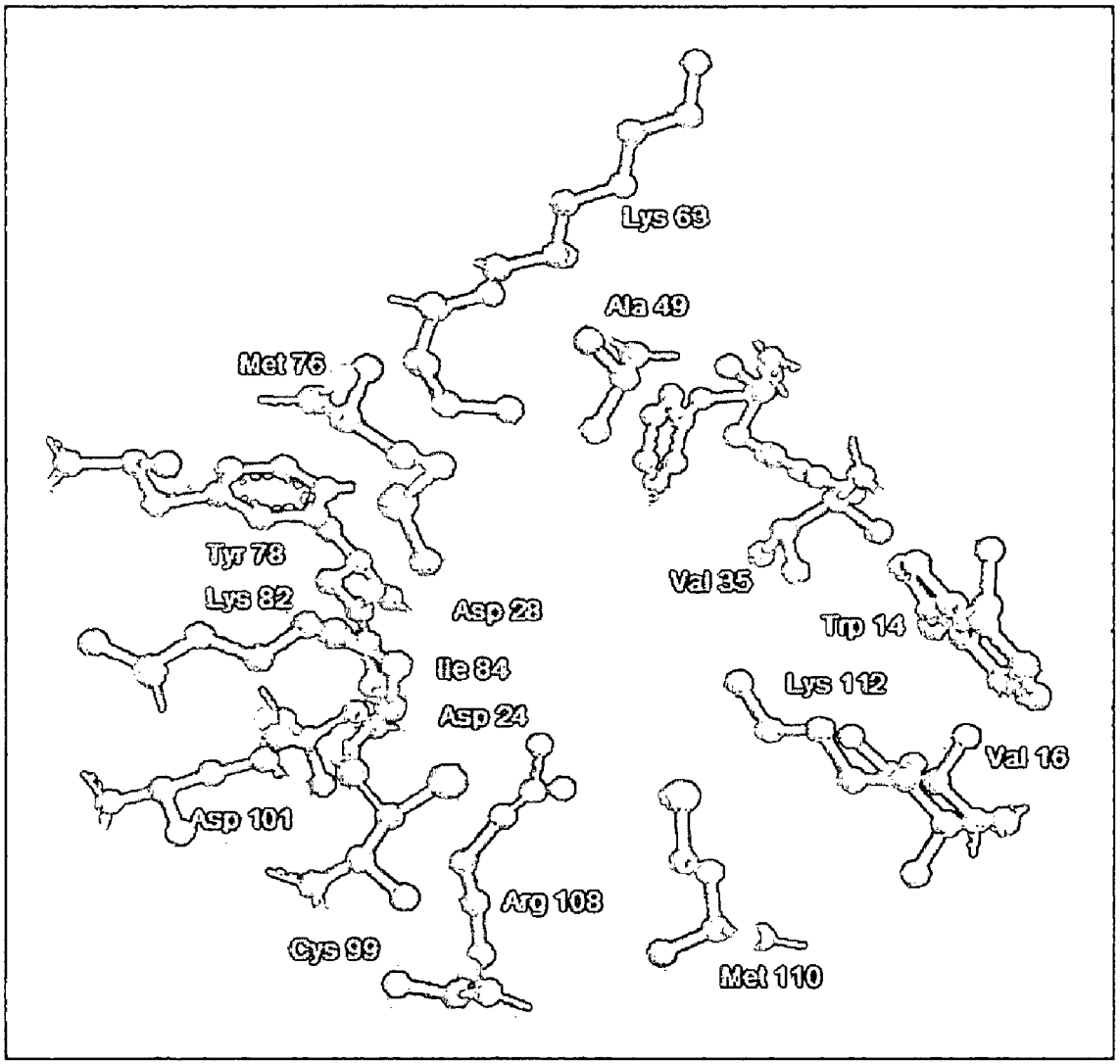
FIG. 3 shows a modeled binding site for $hOBP_{Пα}$.

FIG. 3 shows modeled binding site for $hOBP_{IIa\alpha}$. The conserved hydrophobic amino acids described by Lacazette et al. and thought to interact with ligands are shown.

Figure 4:
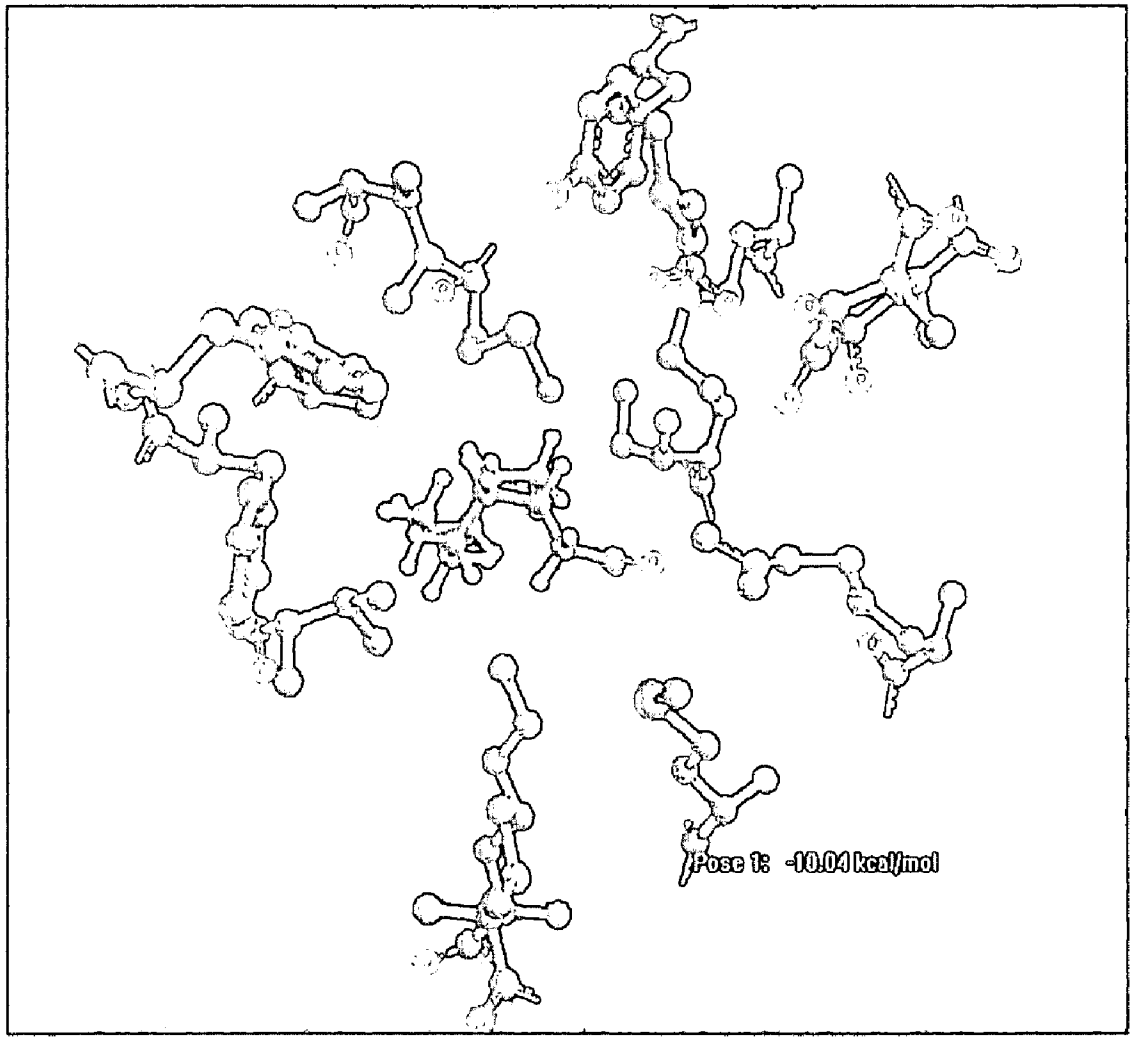
FIG. 4 shows the docked conformation of 1-undecanal in $hOBP_{Пα}$'s binding cavity.

FIG. 4 shows a docked conformation of 1-undecanal in the $hOBP_{IIa\alpha}$ binding cavity using a box size of 19×19.75×15.5 angstroms. The pose shown has docking energy of −10.05 kcal/mol. As an example, 1-undecanal was docked into the binding cleft of $hOBP_{IIa\alpha}$ using Argus lab software 4.0.1 in order to obtain the recognized conformation of the odorant (http://www.planaria-software.com/arguslab40.htm). The docked conformation of 1-undecanal within the binding cleft of the hOBP is show in FIG. 3.

Figure 5:
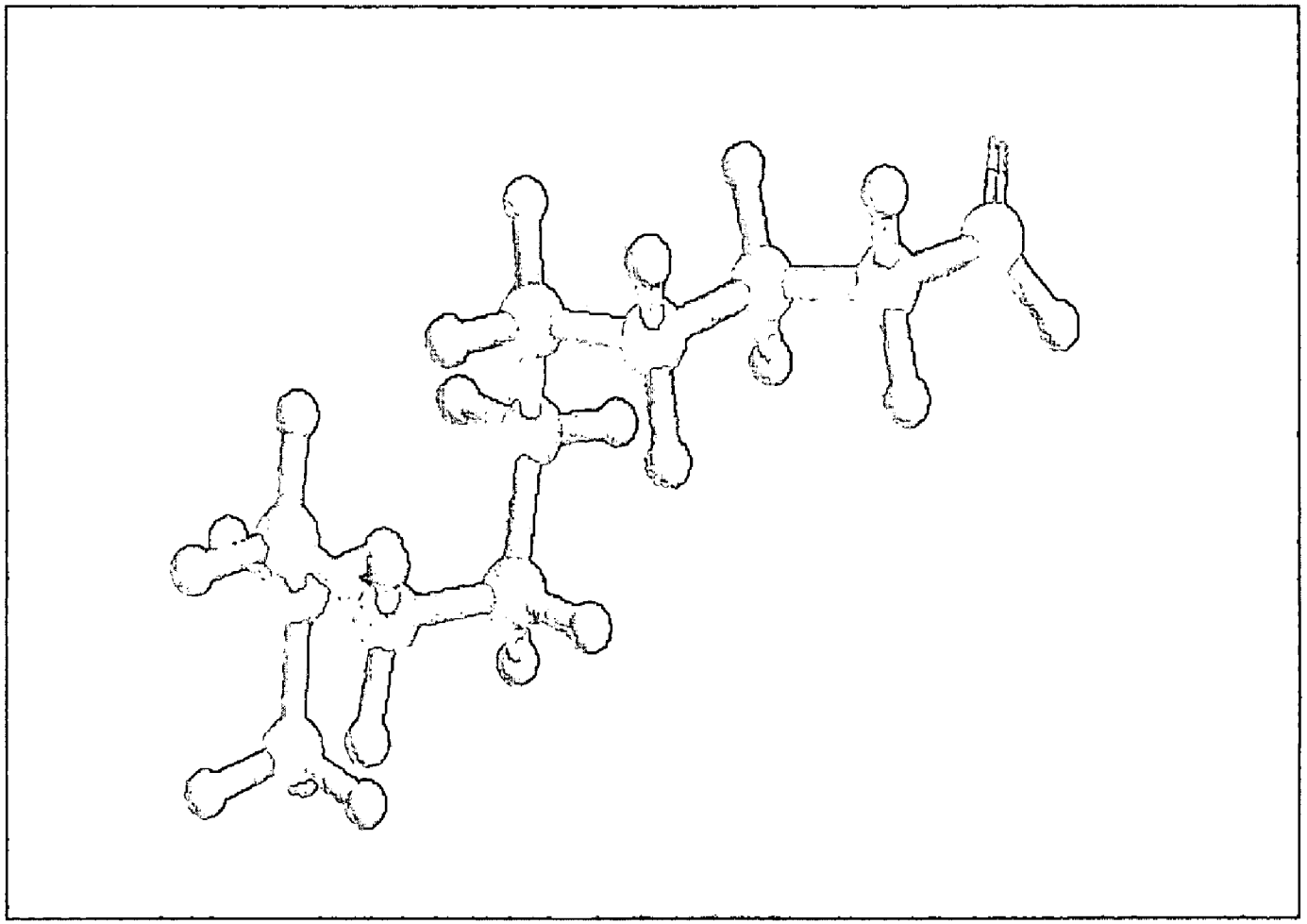
FIG. 5 shows 1-undecanal conformation used in odor index calculation.

FIGS. 4 and 5 show 1-undecanal conformation used in odor index calculation: the conformation for 1-undecanal was deduced from docking experiment into the binding cleft of $hOBP_{IIa\alpha}$. FIG. 4 shows the docked conformation of 1-undecanal in $hOBPi_{IIa\alpha}$'s binding cavity using a box size of 19×19.75×15.5 angstroms. The pose shown has docking energy of −10.05 kcal/mol. As shown in FIG. 5, the conformation for 1-undecanal was deduced from docking experiment into the binding cleft of $hOBP_{IIa\alpha}$.

The most energetically favored conformation for 1-undecanal is used to calculate the maximum moment of inertia using a mathematical model of inertial ellipse.

b. Odor Index Calculation

Moment of Inertia

The inertial ellipse (which is fixed in the rigid body) rolls and reorients on the invariable plane. The path followed on the plane is called the herpolhode. The tip of the vector on the inertial ellipse in which the total angular momentum L is normal rotates on the ellipse to form a path called the polhode. The polhode is the property of the odorant molecule. The invariable plane is a hypothetical plane external to the molecule, which can "fit" into the receptor. The herpolhode is a curve on surface defining receptor site "geometry". The height in which the inertial ellipse sits above the plane is inversely related to the ratio of rotational/translational forces.

The inertial ellipse incorporates the moment of inertia and angular momentum (L) of the odorant in the reference frame in which L is fixed in space.

Translational/Rotational Constant

The translational/rotational constant is a ratio of translational to rotational energy. This factor is found to correlate to the type of functional group and most importantly to the Lydersen critical property increments.

Conformation of 1-undecanal shown in FIGS. 4 and 5 was used to calculate the odor index value of 1-undecanal both in air and in water as an illustrative example. The odor index value in air was found to be equal 0.000219 mg/m$^3$. The experimental value for odor detection threshold in air was determined to be 0.00054 mg/m$^3$ by Randenbrock (See Randebrock, R. E. (1986) Perfuem. Kosmet. 67, 1, 10-24). Calculated odor index in water was calculated to be equal to 8.2 parts per billion (ppb), and found to be within the experimental range determined by Schnabel et al. (Schnabel, K. O. Belitz, H. D., Von Ranson, C. (1988) Lebensm. Unters. Forsch. 187, 215-223).

Odor Index Calculation for Various Odorants

The model and algorithm for odor index calculation was further applied to odorants from various chemical classes. The correlation results with published experimental odor detection thresholds as seen in FIG. 6.

Figure 6:
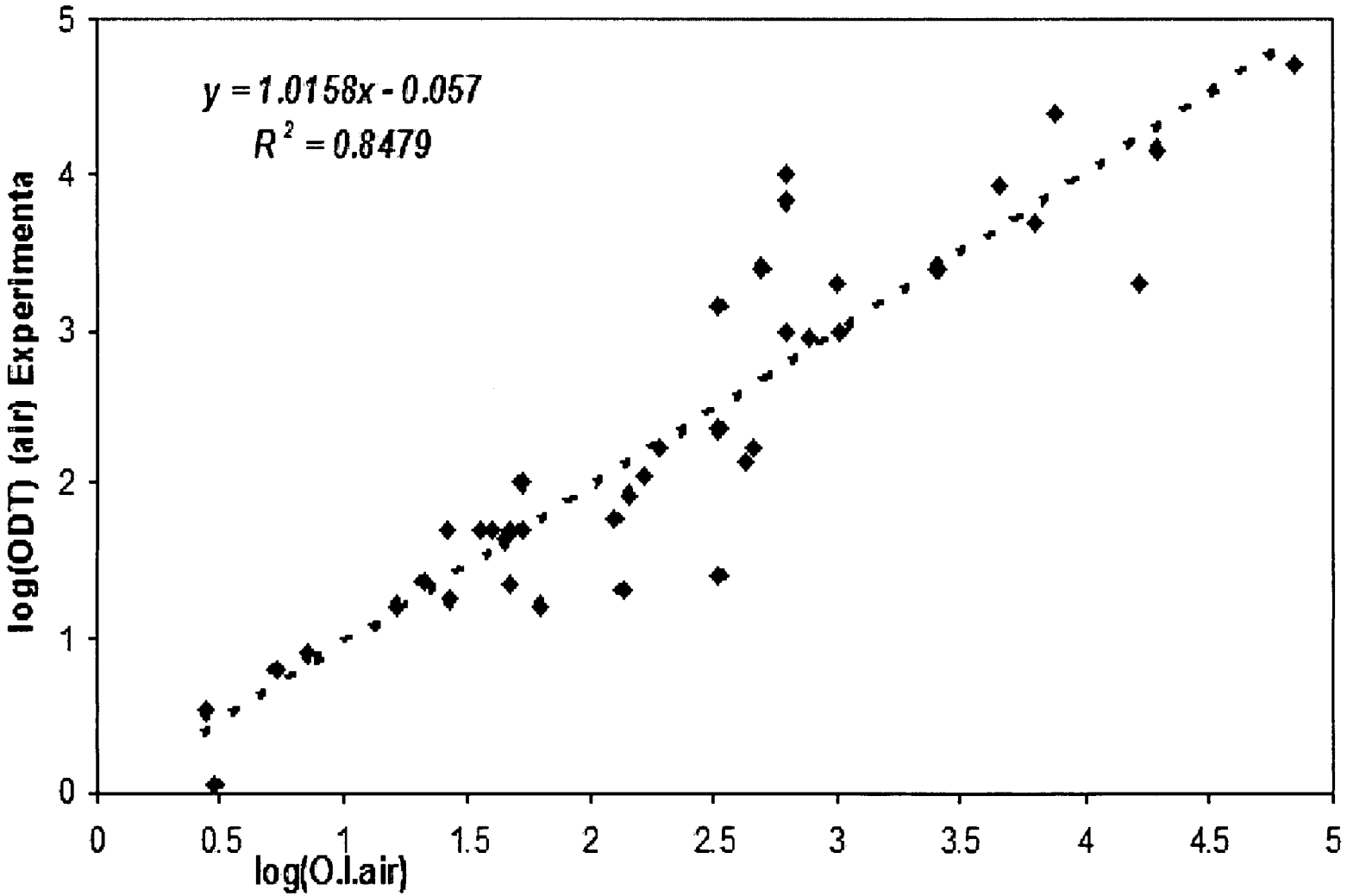
FIG. 6 is a graph of the correlation between calculated odor index and experimental odor detection threshold values.

FIG. 6 shows the correlation between the experimental odor detection threshold values from the "Compilations of Odor Threshold Values in Air" from the Booleans Aroma Chemical Information Service (BACIS) and calculated odor indices of various odorants. (All values are shown in mg/m$^3$.)

Odor Index (O.I.) values can also be calculated in water by correlating the activity of the odorants in a water partition and well as their diffusivity in the water, water-air and air partitions. These calculation results are shown below for some odorants and are correlated with experimental values from the Booleans database for experimental odor detection thresholds in water as shown in Table 8.

TABLE 8

| Name of Odorant | exp ODT (ppb) water | O.I. (ppb) Water |
|---|---|---|
| Butyl acetate | 44-88 | 118.00 |
| 2,6-Dimethyl-2,6-octadien-8-ol | 1-10 | 5.00 |
| trans-3,7-Dimethyl-2,6-octadien-1-yl propanoate | 10 | 2.00 |
| I-1-Methyl-4-isopropenyl-6-cyclohexen-2-one | 50 | 22.00 |
| 4-(2,2,6-Trimethyl-2-cyclohexen-1-yl)-3-buten-2-one | 0.4-10 | 2.5 |
| 4-Hydroxy-3-methoxybenzaldehyde | 25-58 | 27.53 |
| Ethyl butyrate | 1 | 5 |
| 4-(2,2,6-Trimethyl-2-cyclohexen-1-yl)-3-buten-2-one | 0.4-10 | 2.5 |
| 1-(2,6,6-Trimethylcyclohexa-1,3-dienyl)-2-buten-1-one | 0.002 | 0.009 |
| Pentyl butyrate | 44-87 | 68 |
| cis-3-hexenol | 39 | 25 |
| Ethyl 2-methylpentanoate | 0.0030 | 0.001 |
| α-1-(2,6,6-Trimethyl-2-cyclohexen-1-yl)-2-buten-1-one | 1.5 | 1.50 |
| 4-(2,6,6-Trimethyl-1-cyclohexen-1-yl)-3-buten-2-one | 4-6 | 2 |
| ethyl 2-methylbutyrate | 0.1-0.3 | 0.1 |
| 1-Hydroxy-2-methoxy-4-propenylbenzene | 30-40 | 40.00 |
| 2,6-Dimethyl-5-heptenal | 16 | 24 |
| 1-Octanal | 30 | 33 |
| Tetrahydro-4-methyl-2-(2-methylpropen-1-yl)pyran | 0.5 | 4 |
| 4-Hydroxy-3-methoxybenzaldehyde | 20-200 | 28 |
| Pentyl Acetate | 43 | 72 |
| Ethyl methylphenylglycidate | 25 | 3 |
| 5-Methyl-2-isopropylphenol | 400 | 306 |

Applied Perfume Examples

As an illustration, a grapefruit-peach type fragrance was designed according to the rationale described in the invention to fit the application needs of three different wash-off categories: dish-washing and surface cleaners, body wash and shampoos, conditioners, and finally laundry detergents.

Dish Washing and Surface Cleaners

The fragrance designed for these types of application are intended to give a superior impact to the consumer whilst avoiding any hedonics or streak residual on the targeted cleaned surface. One can design a pleasant and full experience for the user of the market product with the engineered perfume while at the same time minimizing substantivity.

Formulations for these types of household and/or industrial applications must contain perfumes that answer to the following criteria: at least 30%, preferably more than 40% of the odorant constituents must have Γ values characteristic of flash release in aqueous dilutions, as described above. At least three of these flash release odorants must have an odor detection threshold in water of less than 50 parts per billion and/or an odor detection threshold in air of less than 0.025 mg/m$^3$.

TABLE 9

| | parts | Γ | Ω | ODT (ppb) |
|---|---|---|---|---|
| Water Release Group1 | | | | |
| d-LIMONENE | 41.60 | 8200.7592 | 536.22897 | |
| ETHYL BUTYRATE | 0.30 | 14612.2887 | 21.165694 | less than 50 ppb |
| total parts | 41.90 | | | |
| Water Release Group 2 | | | | |
| HEXYL ACETATE | 0.90 | 3118.7849 | 1.3050609 | less than 50 ppb |
| LINALOOL | 8.60 | 644.4128 | 0.2646234 | less than 50 ppb |
| TRIPLAL | 0.60 | 1696.1058 | 0.2004637 | less than 50 ppb |
| CIS-3-HEXENYL ACETATE | 0.90 | 1384.2710 | 0.1622188 | less than 50 ppb |
| ETHYL ACETOACETATE | 2.30 | 640.3492 | 0.1061676 | less than 50 ppb |
| ALLYL CAPROATE | 0.30 | 1736.6656 | 0.1098162 | less than 50 ppb |
| VERDOX | 8.60 | 564.5618 | 0.0835701 | less than 50 ppb |
| CIS-3-HEXEN-1-OL | 0.30 | 1569.1101 | 0.0769836 | less than 50 ppb |
| total parts | 22.50 | | | |
| Water Release Group 3 | | | | |
| CITRONELLYL NITRILE | 1.40 | 913.0422 | 0.0681181 | less than 50 ppb |
| FRUCTONE | 1.40 | 554.7882 | 0.0485108 | less than 50 ppb |
| TERPINYL ACETATE | 2.90 | 613.4379 | 0.0292787 | |
| NERYL ACETATE | 1.40 | 456.9131 | 0.0255047 | less than 50 ppb |
| TETRAHYDROLINALOOL | 0.90 | 503.4877 | 0.0151079 | |
| IONONE BETA PURE | 1.40 | 311.3167 | 0.0102709 | less than 50 ppb |
| total parts | 9.40 | | | |
| Water Release Group 4 | | | | |
| OXANE | 0.06 | 610.1552 | 0.0019673 | less than 50 ppb |
| LILIAL | 2.90 | 104.6269 | 0.0017276 | less than 50 ppb |
| PHENOXY ETHYL ISOBUTYRATE | 8.60 | 52.6664 | 0.0011495 | less than 50 ppb |
| ALLYL CYCLOHEXYL PROPIONATE | 0.90 | 126.7982 | 0.0008514 | less than 50 ppb |
| GAMMA UNDECALACTONE | 1.40 | 42.9827 | 0.0006658 | less than 50 ppb |
| GAMMA-DECALACTONE | 0.90 | 115.3553 | 0.0005264 | less than 50 ppb |
| total parts | 14.76 | | | |
| Water Release Group 5 | | | | |
| CYCLOGALBANATE | 0.30 | 134.8094 | 0.0003666 | less than 50 ppb |
| total parts | 0.30 | | | |
| Water release Group 6 | | | | |
| GALAXOLIDE 50 IPM | 5.70 | 7.4931 | 0.00001644 | less than 50 ppb |
| HEDIONE | 2.90 | 8.3964 | 0.00000331 | less than 50 ppb |
| EBANOL | 0.14 | 15.5977 | 0.00000108 | less than 50 ppb |
| CIS-3-HEXENYL SALICYLATE | 0.60 | 2.8007 | 0.00000015 | less than 50 ppb |
| total parts | 9.34 | | | |
| DIPROPYLENE GLYCOL | 1.80 | | | |
| total perfume parts | 100.00 | | | |

The perfume odorants determined by the inventors to result in flash release in water dilutions are in bold: d-limonene, ethyl butyrate, hexyl acetate, triplal, cis-3-hexenyl acetate, allyl caproate, and cis-3-hexenol. These flash release odorants as determined by the authors make up 45% of the total perfume.

The above perfume was included at 0.5% in a typical dish washing product with a formulation provided below in Table 10.

TABLE 10

| Phases | Ingredients | Supplier | Percent |
|---|---|---|---|
| A | D. I. Water | | 82.95 |
| A | Calsoft F-90 | Pilot Chem | 7.00 |
| A | Standamid LD | Cognis Corp. | 3.50 |

TABLE 10-continued

| Phases | Ingredients | Supplier | Percent |
|---|---|---|---|
| B | Standapol ES-2 | Cognis Corp | 6.00 |
| B | Versene 100 | Dow Chem. | 0.05 |
| C | Fragrance | | 0.50 |

The above perfume provides hedonic impact during the washing of glass and other types of dishes as well as surface cleaners while also leaving a minimum amount of residual fragrance or streaks upon completing the cycle or the cleaning experience.

Body-Wash,Soap, Shampoo and Conditoners

It is important to establish that a perfume during a wash off experience for these types of applications must provide a well rounded hedonic experience that will last throughout the entire washing process. Residence time of the chosen odorants within the perfume formula must therefore be optimally based on their acceleration Γ out of the water partition. Since Γ is derived partly based on the vapor pressure and the diffusion coefficients in water, water-air and air, it is an indication of the residence time of odorants.

Grouping odorants in a perfume according to their mass correlated water release values and optimizing specific release groups will serve to result in a longer residence time in headspace and a more rounded hedonic experience for the user during the wash-off. A balance between Ω and Γ values resulting in odorant within water release groups 1, 2, 3 and 4 will ultimately yield a good hedonic release impact of the materials while at the same time provide a longer experience during the wash-off.

Perfumes for wash-off systems such as shampoos, conditioners and body-wash lotions and gels must have at least three different perfume odorants making up 30%, preferably 40% of the total perfume with Γ values characteristic of sustained release, as defined earlier within this patent. These sustained release odorants must also elute between water release groups 1 and 4, based on their Ω values. In order to design a powerful and sustained hedonic release, a measure of the physiological response to these chosen odorants must also be included in the engineering design of the released perfume. Odor detection threshold values and or odor indices as described above must also be considered. At least three of the sustained odorants must have an odor detection threshold in water of 50 ppb or less and/or an odor index in air of less than 0.025 mg/m$^3$.

Below in Table 11 is an illustrative example of a fragrance engineered for sustained release in high water dilutions.

TABLE 11

| | parts | Γ | Ω | ODT (ppb) |
|---|---|---|---|---|
| Water Release Group 1 | | | | |
| d-LIMONENE | 32.03 | 8200.75918 | 412.8705274 | |
| ETHYL BUTYRATE | 0.46 | 14612.28873 | 32.45406391 | less than 50 ppb |
| total parts | 32.49 | | | |
| Water Release Group 2 | | | | |
| HEXYL ACETATE | 1.39 | 3118.784871 | 2.015594108 | less than 50 ppb |
| LINALOOL | 13.24 | 644.4128163 | 0.407396919 | less than 50 ppb |
| TRIPLAL | 0.92 | 1696.105796 | 0.307377724 | less than 50 ppb |
| CIS-3-HEXENYL ACETATE | 1.39 | 1384.270995 | 0.250537947 | less than 50 ppb |
| ETHYL ACETOACETATE | 3.54 | 640.3491788 | 0.163405746 | less than 50 ppb |
| ALLYL CAPROATE | 0.46 | 1736.665583 | 0.168384846 | less than 50 ppb |
| VERDOX | 13.24 | 564.5618108 | 0.128659154 | less than 50 ppb |
| CIS-3-HEXEN-1-OL | 0.46 | 1569.110141 | 0.118041515 | less than 50 ppb |
| CITRONELLYL NITRILE | 2.16 | 913.0421757 | 0.105096515 | less than 50 ppb |
| FRUCTONE | 2.16 | 554.7881788 | 0.074845246 | less than 50 ppb |
| total parts | 38.96 | | | |
| Water Release Group 3 | | | | |
| TERPINYL ACETATE | 4.46 | 613.4379125 | 0.04502868 | |
| NERYL ACETATE | 2.16 | 456.9131114 | 0.039350035 | less than 50 ppb |
| TETRAHYDROLINALOOL | 0.69 | 503.4876831 | 0.01158273 | |
| IONONE BETA PURE | 1.08 | 311.3166919 | 0.007923271 | less than 50 ppb |
| total parts | 8.39 | | | |
| Water Release Group 4 | | | | |
| OXANE | 0.05 | 610.1551529 | 0.001508244 | less than 50 ppb |
| LILIAL | 2.23 | 104.6269183 | 0.001328486 | less than 50 ppb |
| PHENOXY ETHYL ISOBUTYRATE | 6.62 | 52.6663967 | 0.000884842 | less than 50 ppb |
| ALLYL CYCLOHEXYL PROPIONATE | 0.69 | 126.7982325 | 0.000652778 | less than 50 ppb |
| GAMMA UNDECALACTONE | 1.08 | 42.9827363 | 0.000513608 | less than 50 ppb |
| total parts | 10.67 | | | |
| Water Release Group 5 | | | | |
| GAMMA-DECALACTONE | 0.69 | 115.3552787 | 0.00040354 | less than 50 ppb |
| CYCLOGALBANATE | 0.23 | 134.8093664 | 0.000281095 | less than 50 ppb |
| total parts | 0.92 | | | |
| Water Release Group 6 | | | | |
| GALAXOLIDE 50 IPM | 4.39 | 7.493096107 | 0.000012657 | less than 50 ppb |
| HEDIONE | 2.23 | 8.396448605 | 0.000002545 | less than 50 ppb |
| EBANOL | 0.11 | 15.59773278 | 0.000000831 | less than 50 ppb |
| CIS-3-HEXENYL SALICYLATE | 0.46 | 2.800719742 | 0.000000115 | less than 50 ppb |
| total parts | 7.19 | | | |
| DIPROPYLENE GLYCOL | 1.39 | | | |
| TOTAL PERFUME PARTS | 100.00 | | | |

The perfume odorants determined by the inventors to result in a sustained release in water dilutions are: linalool, ethyl acetoacetate, verdox, citronellyl nitrile, fructone, terpinyl acetate, neryl acetate, tetrahydrolinalool, beta ionone, lilial and allyl cyclohexyl propionate, gamma-decalactone and cyclogalabanate. These sustained release odorants as determined by the authors make up 45.65% of the total perfume.

The above perfume was put at 1% in a house base shampoo formulated according to the formula below in Table 12. During use, the product gave a well-rounded impactful experience to the user.

TABLE 12

| Phases | Ingredients | Supplier | Percent |
|---|---|---|---|
| A | D. I. Water | | 34.00 |
| A | Standapol ES-2 | Cognis Corp. | 35.00 |
| B | Standapol WAQ-LC | Cognis Corp | 27.50 |
| B | Glydant 2000 | Lonza | 0.30 |
| C | Sodium Chloride | | 1.80 |
| D | Fragrance | | 1.00 |

Laundry Products

At the end of a typical wash cycle, perfume deposition is often minimal due to the relative solubility and water-release values of a number of odorants making up a typical perfume in addition to the large amount of water used during a typical household wash cycle. It is therefore important to engineer fragrances with maximum deposition on woven and non-woven surfaces for obvious commercial and environmental reasons when considering these types of household and industrial applications.

Since water release values are derived based on activity and water diffusion coefficients of odorants in water, as well as partition energies of these odorants for polar and non polar partitions, vapor pressure etc., it is possible to predict quantitatively the substantivity of the individual odorants considered in the perfume in water.

Based on the Ω values of odorants and their subsequent grouping in various release groups, it is possible to engineer certain hedonic notes or perfumes to be perceived by the consumer after wash-off, upon completing a laundry cycle. In addition, this fragrance design limits unnecessary environmental waste of the perfume used in formulating the wash product during the wash procedure.

Perfumes intended for maximum deposition in wash-off systems must have at least three different odorants constituting 40% and preferably at least 50% of the total perfume within water release groups 4 and/or 5 and/or 6 according to the method described in the herein invention and with non-release Γ values, i.e. less than 100. At least three different odorants must have an odor detection threshold in water of less than 50 parts per billion and/or an odor detection threshold in air of less than 0.025 mg/m$^3$.

To illustrate the importance of Ω values in designing perfumes for this laundry detergents, the below fragrance is shown below in Table 13.

TABLE 13

| | parts | Γ | Ω | ODT (ppb) |
|---|---|---|---|---|
| Water Release Group 1 | | | | |
| d-LIMONENE | 21.28 | 8200.7592 | 274.3017428 | |
| ETHYL BUTYRATE | 0.15 | 14612.289 | 10.5828469 | less than 50 ppb |
| total parts | 21.43 | | | |
| Water Release Group 2 | | | | |
| HEXYL ACETATE | 0.46 | 3118.7849 | 0.6670311 | less than 50 ppb |
| LINALOOL | 4.42 | 644.4128 | 0.1360041 | less than 50 ppb |
| TRIPLAL | 0.31 | 1696.1058 | 0.1035729 | less than 50 ppb |
| CIS-3-HEXENYL ACETATE | 0.46 | 1384.271 | 0.0829118 | less than 50 ppb |
| total parts | 5.65 | | | |
| Water Release Group 3 | | | | |
| ETHYL ACETOACETATE | 1.18 | 640.3492 | 0.0544686 | less than 50 ppb |
| ALLYL CAPROATE | 0.15 | 1736.6656 | 0.0549081 | less than 50 ppb |
| VERDOX | 4.42 | 564.5618 | 0.0429512 | less than 50 ppb |
| CIS-3-HEXEN-1-OL | 0.15 | 1569.108 | 0.0384918 | less than 50 ppb |
| CITRONELLYL NITRILE | 0.72 | 913.04218 | 0.0350322 | less than 50 ppb |
| FRUCTONE | 0.72 | 554.78818 | 0.0249484 | less than 50 ppb |
| TERPINYL ACETATE | 1.49 | 613.43791 | 0.0150432 | |
| NERYL ACETATE | 0.72 | 456.91311 | 0.0131167 | less than 50 ppb |
| TETRAHYDROLINALOOL | 1.85 | 503.48768 | 0.0310551 | |
| IONONE BETA PURE | 2.88 | 311.31669 | 0.0211287 | less than 50 ppb |
| total parts | 14.28 | | | |
| Water Release Group 4 | | | | |
| OXANE | 0.12 | 610.15515 | 0.0039345 | less than 50 ppb |
| LILIAL | 5.95 | 104.62692 | 0.0035446 | less than 50 ppb |
| PHENOXY ETHYL ISOBUTYRATE | 14.32 | 52.666397 | 0.0019140 | less than 50 ppb |
| ALLYL CYCLOHEXYL PROPIONATE | 1.85 | 126.79823 | 0.0017502 | less than 50 ppb |
| GAMMA UNDECALACTONE | 2.88 | 42.982736 | 0.0013696 | less than 50 ppb |
| GAMMA-DECALACTONE | 1.85 | 115.35528 | 0.0010820 | less than 50 ppb |
| CYCLOGALBANATE | 1.24 | 134.80937 | 0.0015155 | less than 50 ppb |
| total parts | 28.21 | | | |

TABLE 13-continued

| | parts | Γ | Ω | ODT (ppb) |
|---|---|---|---|---|
| Water Release Group 5 | | | | |
| GALAXOLIDE 50 IPM | 14.00 | 7.4930961 | 0.0000404 | less than 50 ppb |
| HEXYL CINNAMIC ALDEHYDE | 2.83 | 21.014233 | 0.0000461 | less than 50 ppb |
| total parts | 16.83 | | | |
| Water Release Group 6 | | | | |
| LYRAL | 2.83 | 6.500843 | 0.0000035 | less than 50 ppb |
| HEDIONE | 5.95 | 8.3964486 | 0.0000068 | less than 50 ppb |
| EBANOL | 0.25 | 15.597733 | 0.0000019 | less than 50 ppb |
| CIS-3-HEXENYL SALICYLATE | 1.24 | 2.8007197 | 0.0000003 | less than 50 ppb |
| BENZYL SALICYLATE | 3.33 | 1.7312373 | 0.0000004 | |
| total parts | 13.60 | | | |
| total Perfume parts | 100.00 | | | |

A total of 47.63% of the above perfume is composed of non-release odorants under heavy aqueous dilutions based on the odorants' Γ values. The substantive odorants are: phenoxy ethyl isobutyrate, gamma-undecalactone, galaxolide, hexyl cinnamic aldehyde, lyral, hedione, ebanol, cis-3-hexenyl salicylate and benzyl salylate.

The above description is for the purposes of teaching the person of ordinary skill in the art how to practice the present invention, and it is not intended to detail all those obvious modifications and variations of it which will become apparent to the skilled worker upon reading the description.

What is claimed is:

1. A method of formulating a perfume composition for wash-off systems, comprising:

calculating values of odor detection threshold, odor detection threshold in air, acceleration (Γ) flash water release (Ω) values for a group of odorants;

selecting at least three different odorants, each odorant having an acceleration (Γ) value of about 1000 or greater, a flash release (Ω) value selected from the group consisting of about 10 or greater, from about 0.07 to about 10, and from about 0.007 to about 0.07, and a property selected from the group consisting of an odor detection threshold of about 50 parts per billion or less, an odor detection threshold in air of about 0.025 $mg/m^3$ or less, and combinations of these; and placing the perfume composition in a wash-off system to provide an initial water release and a minimal residual perfume on a targeted surface after wash-off.

2. The method of claim 1, wherein the wash-off system is selected from the group consisting of surface cleaner and dishwashing detergent.

3. The method of claim 1, wherein the odorants comprise at least about 30% of the perfume composition.

4. The method of claim 1, wherein the odorants comprise at least about 40% of the perfume composition.

5. A method of formulating a perfume composition for wash-off systems, comprising:

calculating values of odor detection threshold, odor detection threshold in air, acceleration (Γ), and flash water release (Ω) values for a group of odorants;

selecting at least three different odorants, each odorant having an acceleration (Γ) value from about 100 to about 1000, a flash release (Ω) value selected from the group consisting of about 10 or greater, from about 0.07 to about 10, from about 0.007 to about 0.07, and from about 0.0005 to about 0.007, and a property selected from the group consisting of an odor detection threshold of about 50 parts per billion or less, an odor detection threshold in air of about 0.025 $mg/m^3$ or less, and combinations of these; and placing the perfume in a wash-off system to provide a long sustained perfume release and hedonic experience during the wash-off event.

6. The method of claim 5, wherein the wash-off system is selected from the group consisting of a shampoo, conditioner, body wash and soap.

7. The method of claim 5, wherein the odorants comprise at least about 30% of the perfume composition.

8. The method of claim 5, wherein the odorants comprise at least about 40% of the perfume composition.

9. A method of formulating a perfume composition for wash-off systems, comprising:

calculating values of odor detection threshold, odor detection threshold in air, acceleration (Γ), and flash water release (Ω) values for a group of odorants;

selecting at least three different odorants, each odorant having an acceleration (Γ) value of about 100 or less, a flash release (Ω) value selected from the group consisting of about 10 or greater, from about 0.07 to about 10, from about 0.007 to about 0.07, from about 0.0005 to about 0.007, from about 0.00003 to about 0.0005, and about 0.00003 or less, and a property selected from the group consisting of an odor detection threshold of about 50 parts per billion or less, an odor detection threshold in air of about 0.025 $mg/m^3$ or less, and combinations of these; and placing the perfume composition in a wash-off system to provide residual fragrance deposition.

10. The method of claim 9, wherein the wash-off system is selected from the group consisting of shampoo, conditioner, body wash and soap.

11. The method of claim 9, wherein the odorants comprise at least about 40% of the perfume composition.

12. The method of claim 9, wherein the odorants comprise at least about 50% of the perfume composition.

* * * * *